US008646626B2

(12) United States Patent
Hsu et al.

(10) Patent No.: US 8,646,626 B2
(45) Date of Patent: Feb. 11, 2014

(54) WALL MOUNTING BATH ACCESSORY ASSEMBLY

(75) Inventors: Weimien Hsu, Taichung (TW); Chunhung Li, Taichung (TW); Fenyong Nan, Guangdong Pr (CN)

(73) Assignee: Globe Union Industrial Corp., Taichung (TW)

( * ) Notice: Subject to any disclaimer, the term of this patent is extended or adjusted under 35 U.S.C. 154(b) by 601 days.

(21) Appl. No.: 12/983,190

(22) Filed: Dec. 31, 2010

(65) Prior Publication Data

US 2012/0168583 A1 Jul. 5, 2012

(51) Int. Cl.
*A47G 29/087* (2006.01)

(52) U.S. Cl.
USPC ..... 211/119.009; 248/222.11; 248/222.13

(58) Field of Classification Search
USPC ..... 248/222.13, 223.41, 222.11, 224.7, 248/222.12, 221.11, 251, 220.22, 220.21, 248/304; 211/16, 105, 123, 119.009
See application file for complete search history.

(56) References Cited

U.S. PATENT DOCUMENTS

| | | | | | |
|---|---|---|---|---|---|
| 1,915,230 | A * | 6/1933 | Hooper | 248/221.11 |
| 2,127,230 | A * | 8/1938 | Moineau | 248/222.11 |
| 2,144,602 | A * | 1/1939 | Balmer | 248/250 |
| 3,036,803 | A * | 5/1962 | Fiebelkorn | 248/221.11 |
| 4,645,316 | A * | 2/1987 | Ohyama | 248/481 |
| 4,718,625 | A * | 1/1988 | Boda | 248/222.11 |
| 5,035,389 | A * | 7/1991 | Wang | 248/224.51 |
| 5,402,977 | A * | 4/1995 | Korfgen et al. | 248/309.1 |
| 6,520,463 | B1 * | 2/2003 | Ouano | 248/222.13 |
| 6,810,538 | B2 * | 11/2004 | Ouyoung | 4/576.1 |
| 7,686,265 | B2 * | 3/2010 | Hall | 248/222.11 |
| 7,926,772 | B2 * | 4/2011 | Lowe et al. | 248/222.14 |
| 2011/0266404 | A1 * | 11/2011 | Hsu et al. | 248/222.14 |

* cited by examiner

*Primary Examiner* — Korie H Chan

(57) ABSTRACT

A wall mounting bath accessory assembly contains a fixing member including an inner wall, an outer wall, and two side walls; the inner wall including at least one recess and a retaining fence; on a connecting corner of each side wall and the outer wall being fixed a first resilient lock block, and the first resilient lock block including a first arcuate projection; a base formed in a cover shape and including a groove in which an opening is formed so that the fixing member is received in the groove via the opening, the groove including two first positioning ribs, and each first positioning rib including a first engaging slot; the groove also including two second positioning ribs, and each second positioning rib including a second engaging slot formed on a top end thereof proximate to the opening.

13 Claims, 11 Drawing Sheets

WALL MOUNTING BATH ACCESSORY ASSEMBLY

BACKGROUND OF THE INVENTION

1. Field of the Invention

The present invention relates to a wall mounting bath accessory assembly to be fixed on a wall surface.

2. Description of the Prior Art

A conventional wall mounting bath accessory assembly is used in a rack to hold cloth, cap, towel and toilet papers, and includes a fixing member and a base. The fixing member is locked to a wall by using an anchor and a first bolt element, and includes a peripheral surface to be covered by a disc-shaped cover on the base, and a second bolt elements is inserted through the cover to retain the base to the fixing member, however, such a base disengages from the wall surface easily and is removed difficulty.

To overcome above-mentioned shortcomings, an improved wall mounting bath accessory assembly is disclosed in CN Pat. Nos. 201365798 and 2601614, and US Pub. No. US 20090108157 that include a retaining member to be locked to the base in advance so that the base is fixed by using the retaining member and the fixing member without applying any bolt elements.

However, the retaining member engages with the fixing member vertically, therefore when the bath accessory assembly moves, the base disengaged from the fixing member easily by using a common disassembling operation. Therefore, the base and the retaining member are removed easily that will be taken away if they are made of precious metal materials. To obtain a theft-proof purpose, a wall mounting bath accessory assembly has to be removed by using a specific but easy operation.

The present invention has arisen to mitigate and/or obviate the afore-described disadvantages.

SUMMARY OF THE INVENTION

The primary object of the present invention is to provide a wall mounting bath accessory assembly which is capable of overcoming the shortcomings of the conventional wall mounting bath accessory assembly.

A secondary object of the present invention is to provide a wall mounting bath accessory assembly that when the base is touched, it is stopped to fall from the fixing member, obtaining a safe purpose.

Further Also further object of the present invention is to provide a wall mounting bath accessory assembly that is removed uneasily to achieve a theft-proof purpose.

Also further object of the present invention is to provide a wall mounting bath accessory assembly that when the second resilient lock block of the first positioning rib of the base engages with the post of the fixing member, and the second engaging slot of the second positioning rib engages with the first resilient lock block of the fixing member, a noise is made to be sure the connecting position is corrected.

Another object of the present invention is to provide a wall mounting bath accessory assembly that the base is disassembled easy and quickly, and all related parts are less to lower production cost and a size of the fixing member and the base.

To obtain the above objectives, a wall mounting bath accessory assembly provided by the present invention contains a fixing member including an inner wall, an outer wall, and two side walls; the inner wall including at least one recess disposed on an upper side thereof and a retaining fence defined between each recess and the outer wall; on a connecting corner of each side wall and the outer wall being fixed a first resilient lock block, and the first resilient lock block including a first arcuate projection formed thereon;

a base formed in a cover shape and including a groove in which an opening is formed so that the fixing member is received in the groove via the opening, and the groove including two first positioning ribs extending from an inner surface of a top end thereof, and each first positioning rib including a first engaging slot disposed on a bottom end thereof adjacent to the opening so that the first engaging slot engages with the retaining fence, hence a top end of the base is limited without moving outward; the groove including two second positioning ribs extending from an inner surface of a bottom end thereof, and each second positioning rib including a second engaging slot formed on a top end thereof proximate to the opening so that the second engaging slot of the second positioning rib engages with the retaining fence of the fixing member, hence a bottom end of the base is moved inward so that the first resilient lock block of the fixing member is pressed to cause a flexible deformation to move, and then the first resilient lock block moves into the second engaging slot of the second positioning rib to be retained, a bottom periphery of the first resilient lock block abutting against a bottom face of the second engaging slot so that the bottom end of the base is stopped without moving upward.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
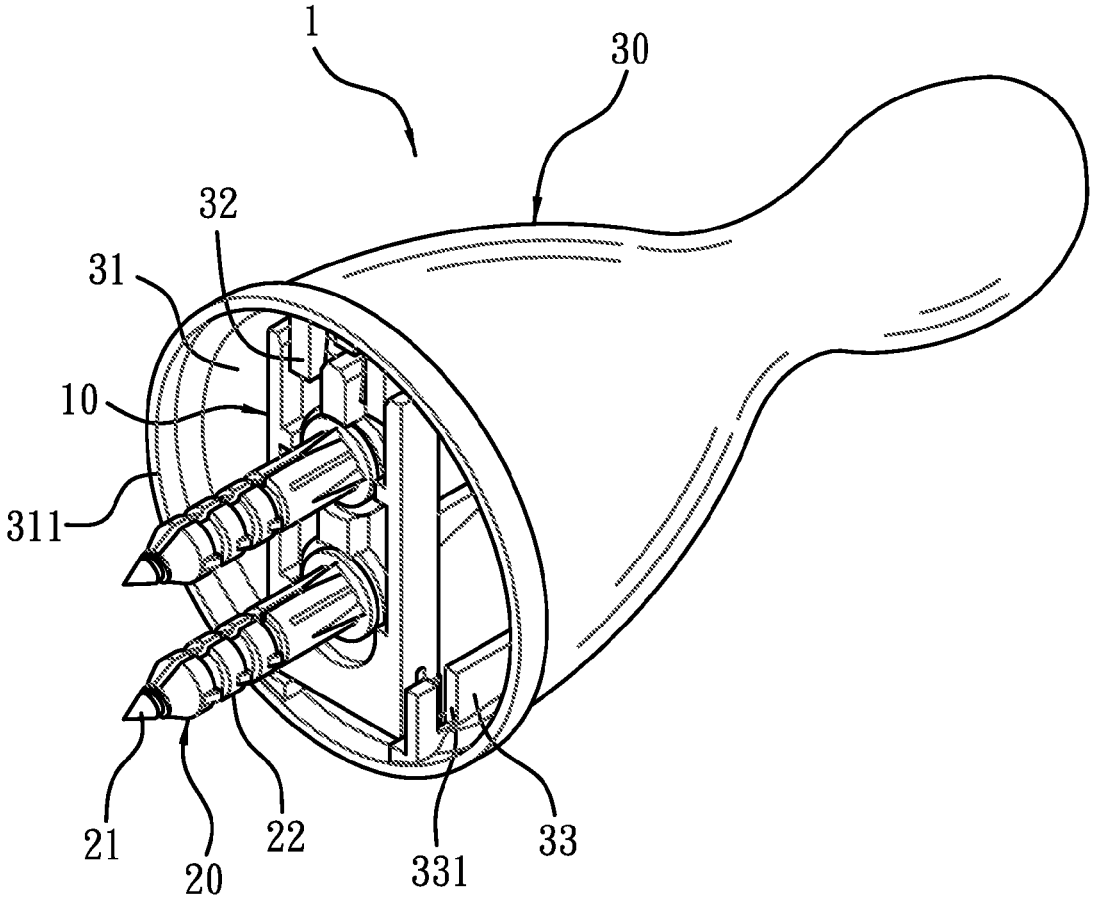
FIG. 1 is a perspective view showing the assembly of a wall mounting bath accessory assembly according to a first embodiment of the present invention.
Figure 2:
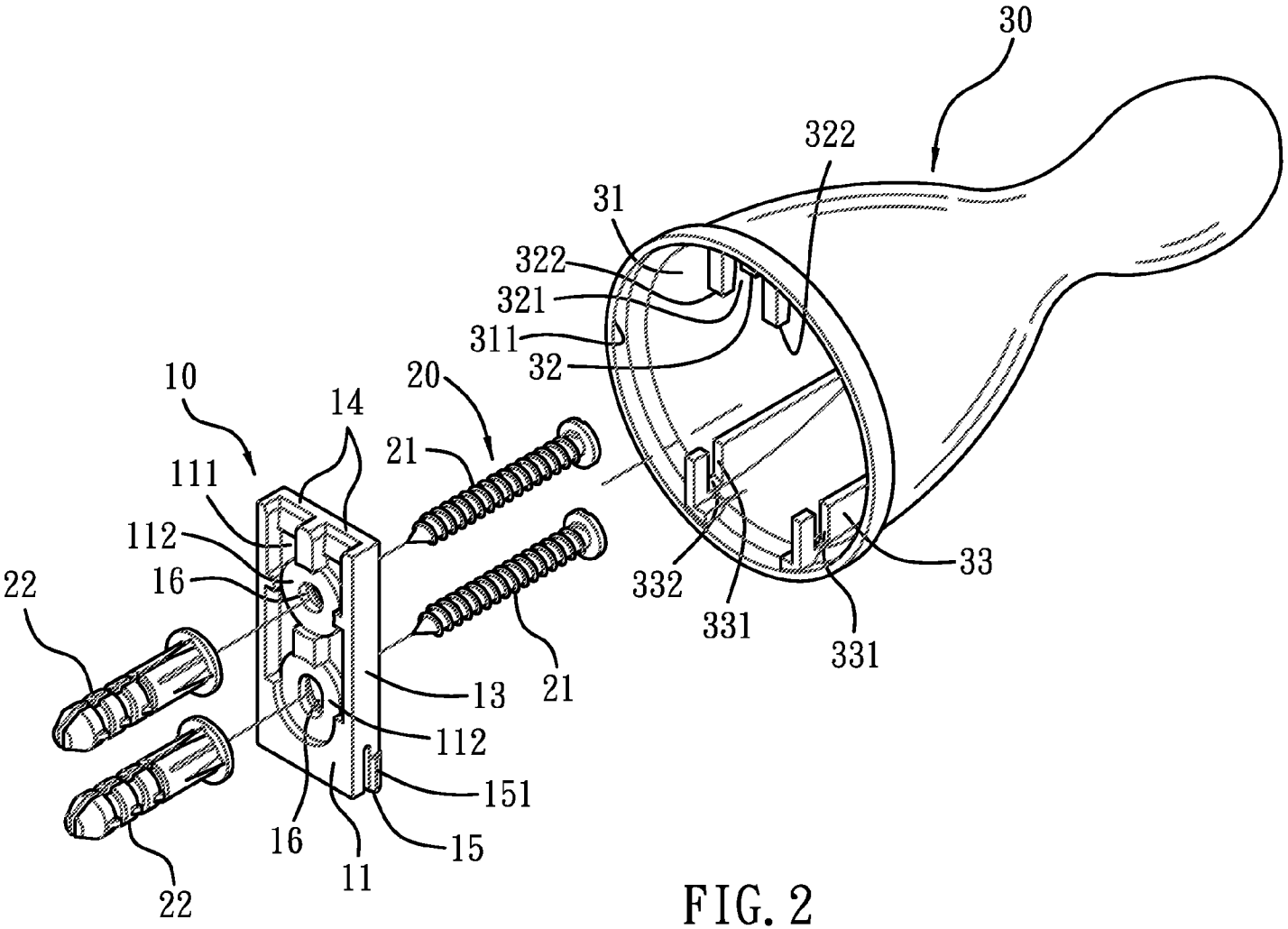
FIG. 2 is a perspective view showing the exploded components of the wall mounting bath accessory assembly according to the first embodiment of the present invention.

Referring to FIGS. 1-2, a wall mounting bath accessory assembly 1 according to a first embodiment of the present invention comprises a fixing member 10, a locking device 20, and a base 30.

Figure 4:
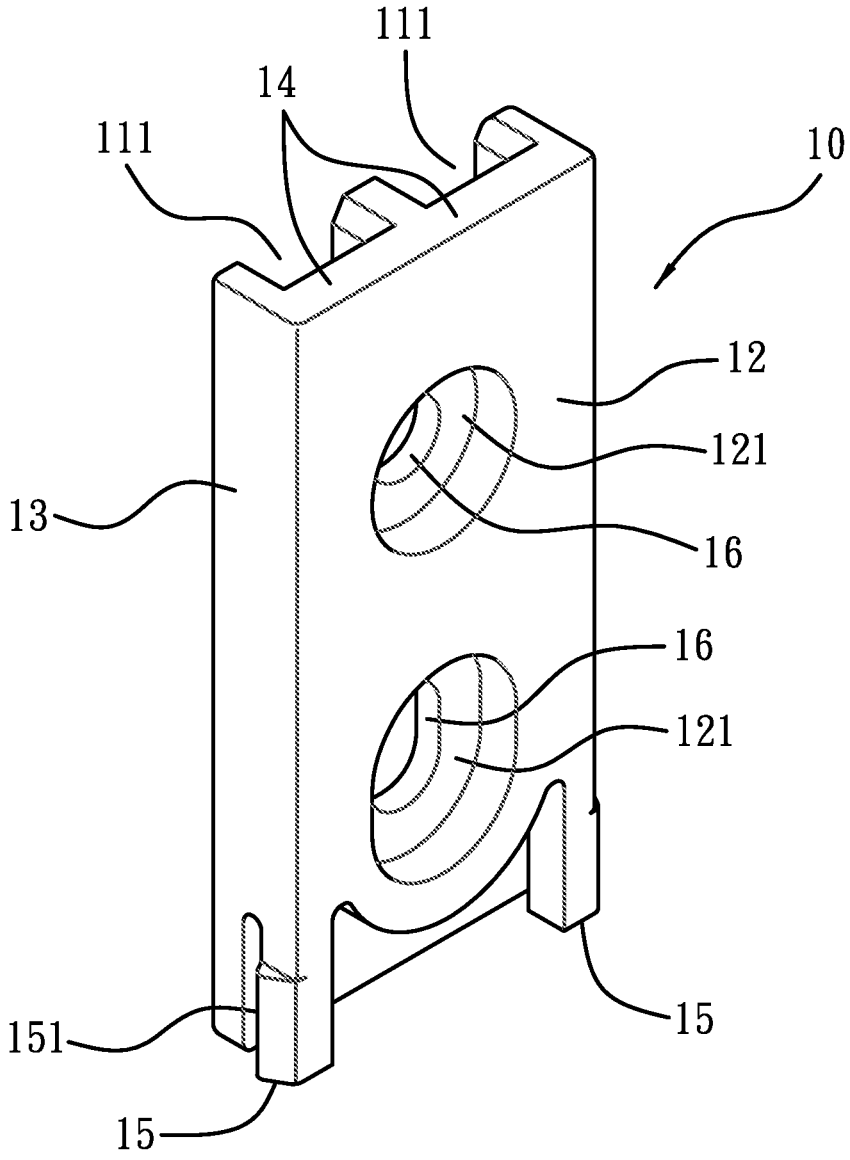
FIG. 4 is a perspective view showing the assembly of a fixing member of the wall mounting bath accessory assembly according to the first embodiment of the present invention.

The fixing member 10, as shown in FIG. 4, includes an inner wall 11, an outer wall 12, and two side walls 13; the inner wall 11 is used to contact with an outer face 2*a* of a fringe 2 tightly and includes two recesses 111 disposed on an upper side thereof, between each recess 111 and the outer wall 12 is defined a retaining fence 14; on a connecting corner of each side wall 13 and the outer wall 12 is fixed a first resilient lock block 15, and the first resilient lock block 15 includes a first arcuate projection 151 formed thereon.

The fixing member 10 includes two holes 16 vertically arranged thereon, and one of the holes 16 is circular, and the other hole 16 is elongated, the inner wall 11 and the outer wall 12 of the fixing member 10 include two first recessed rims 112 and two second recessed rims 121 fixed thereon respectively to arrange the two holes 16.

The locking device 20 is applied to engage the inner wall 11 of the fixing member 10 with the outer face 2*a* of the fringe 2 tightly and includes two bolt elements 21 and two anchors 22 retained in the outer face 2*a*, such that the bolt elements 21 are inserted through the holes 16 of the fixing member 10 to screw with the anchors 22 of the fringe 2 so that the inner wall 11 of the fixing member 10 contacts with the outer face 2*a* of the fringe 2.

Figure 9:
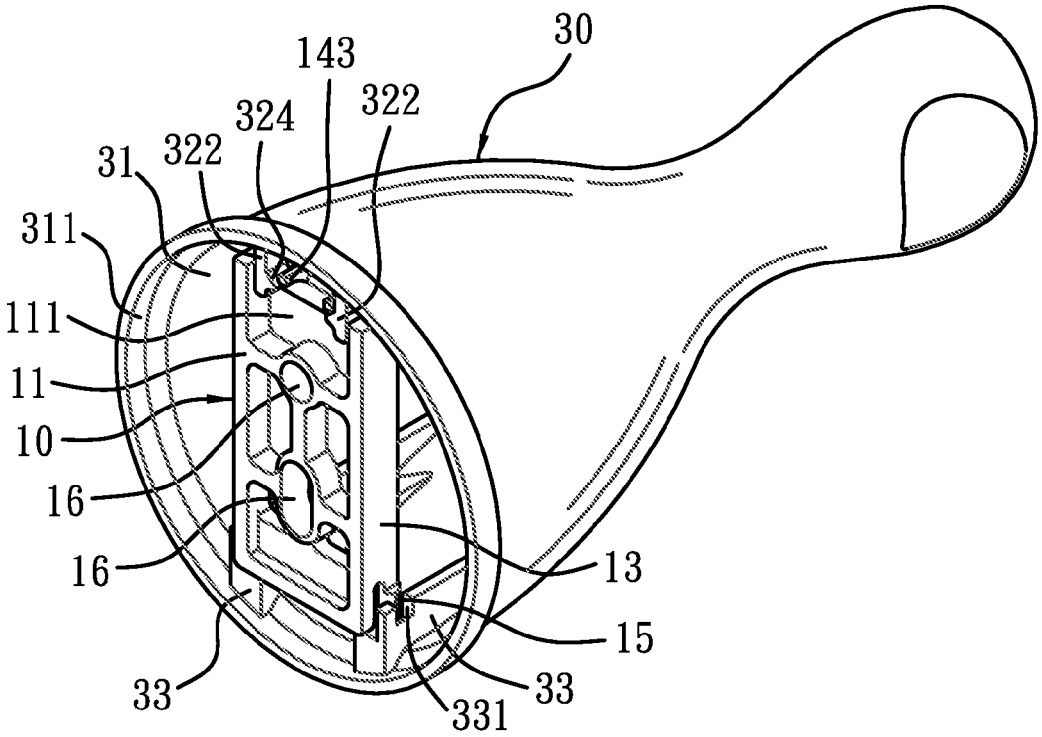
FIG. 9 is a perspective view showing the assembly of a fixing member and a base of the wall mounting bath accessory assembly according to a second embodiment of the present invention.

It is to be noted that the fixing member 10 is fixed by using the bolt elements 21 and the anchors 22 of the locking device 20. To prevent the inner wall 11 of the fixing member 10 from being stopped by a first head end 221 of the anchor 22, it is provided with the recess 111 as illustrated in FIG. 9. Also, the inner wall 11 of the fixing member 10 is wide and deep enough to receive the first head end 221 of the anchor 22 which exposes outside the outer face 2*a* of the fringe 2. The second recessed rim 121 of the outer wall 12 of the fixing member 10 is served to receive a second head end 211 of the bolt element 21 after the bolt element 21 is inserted through the hole 16 as shown in FIG. 9.

Figure 5:
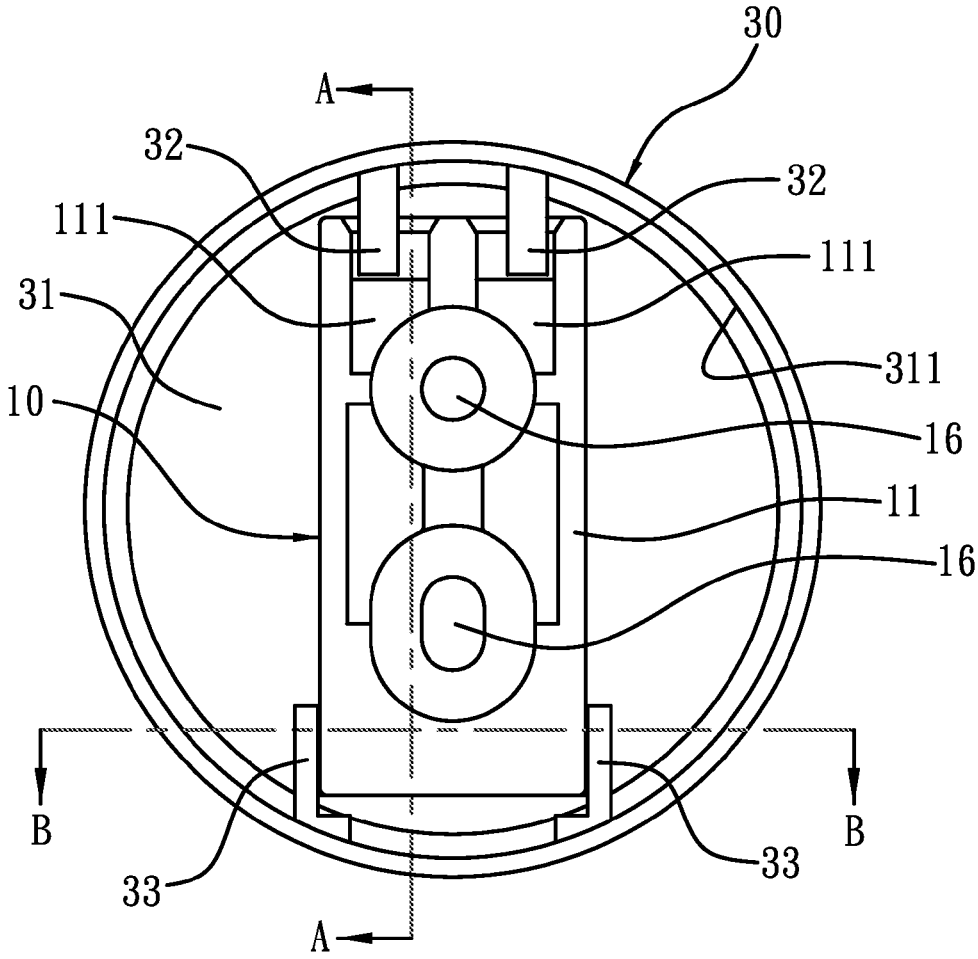
FIG. 5 is a plan view showing the assembly of the fixing member and a base of the wall mounting bath accessory assembly according to the first embodiment of the present invention.
Figure 6:
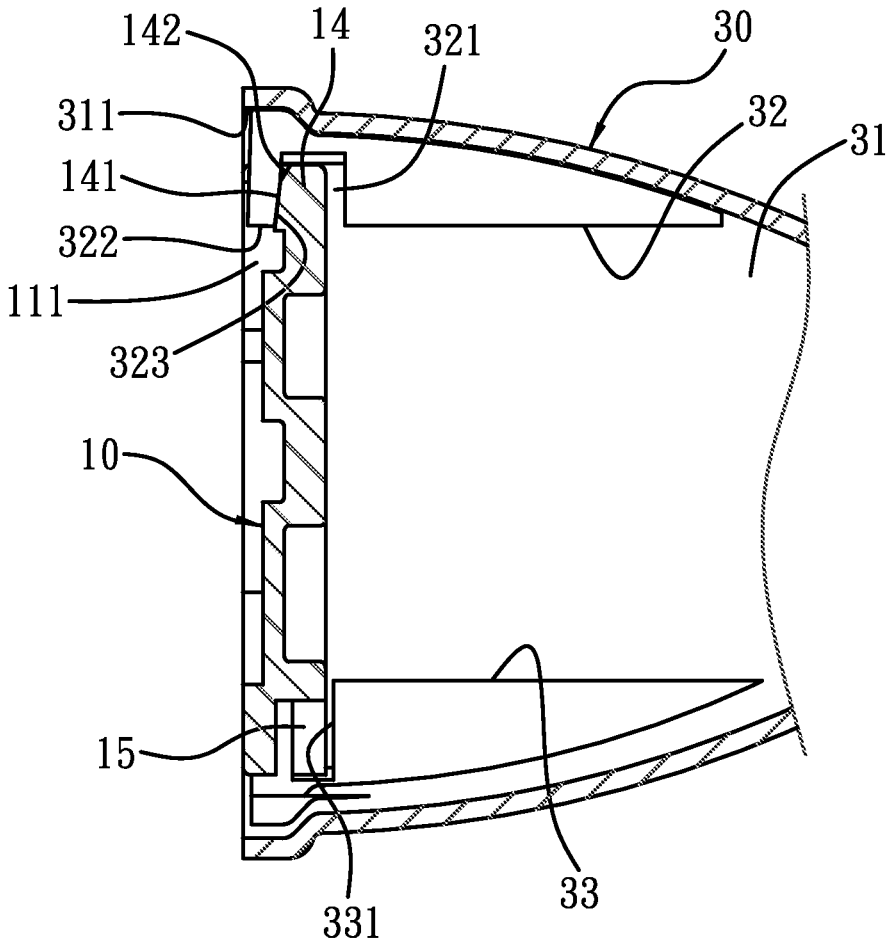
FIG. 6 is a cross sectional view taken along the line A-A of FIG. 5.
Figure 7:
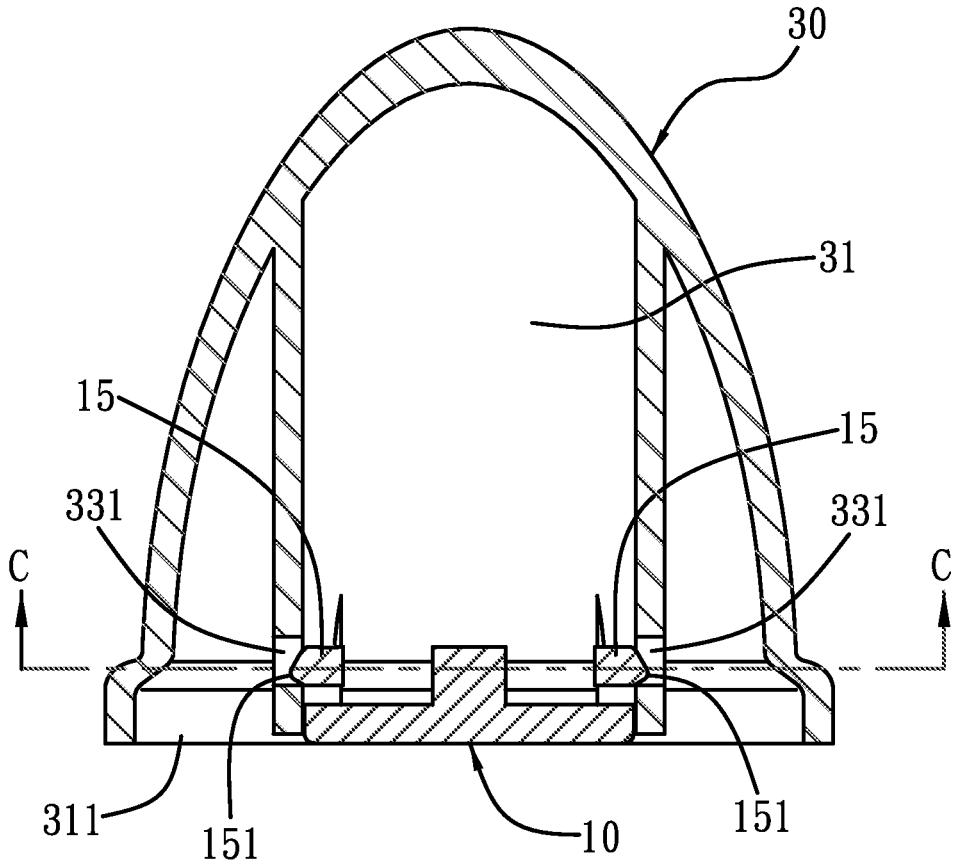
FIG. 7 is a cross sectional view taken along the line B-B of FIG. 5.
Figure 8:
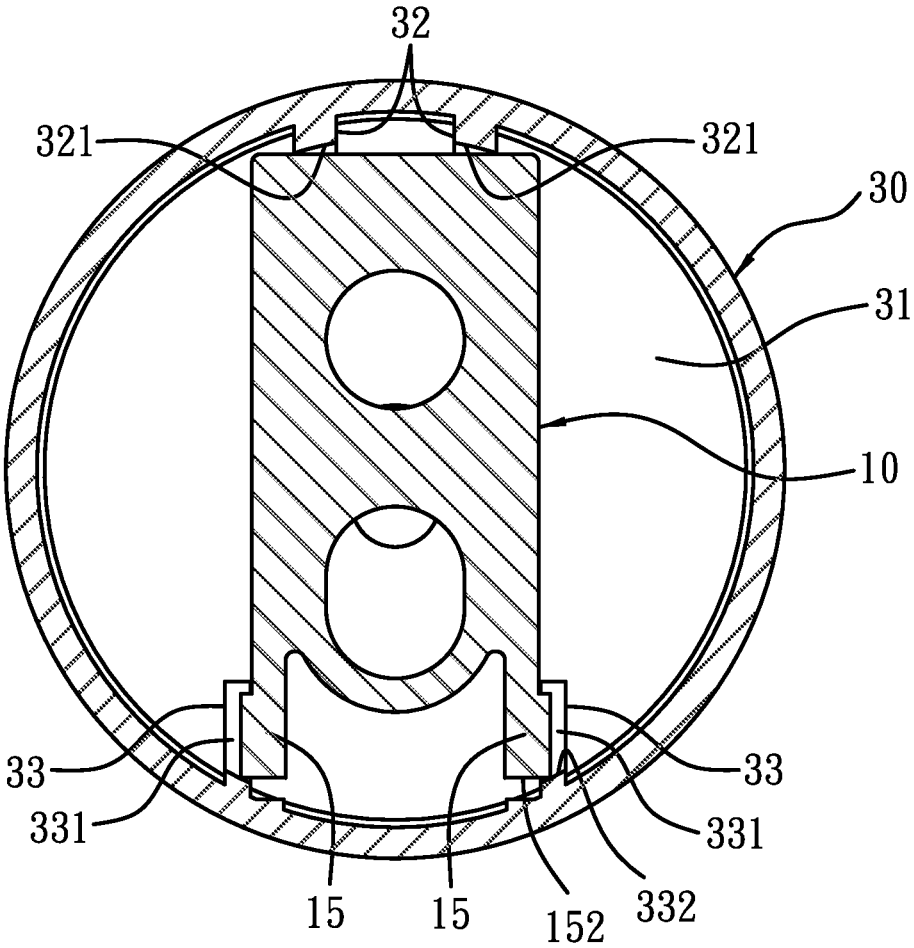
FIG. 8 is a cross sectional view taken along the line C-C of FIG. 7.

The base 30, as illustrated in FIG. 2, is formed in a cover shape and includes a groove 31 in which an opening 311 is formed so that the fixing member 10 is received in the groove 31 via the opening 311, and the groove 31 includes two first positioning ribs 32 extending from an inner surface of a top end thereof, and each first positioning rib 32 includes a first engaging slot 321 disposed on a bottom end thereof adjacent to the opening 311 so that the first engaging slot 321 engages with the retaining fence 14 as illustrated in FIGS. 5 and 6, hence a top end of the base 30 is prevented from moving outward from the fixing member 10; the groove 31 includes two second positioning ribs 33 extending from an inner surface of a bottom end thereof, and each second positioning rib 33 includes a second engaging slot 331 formed on a top end thereof proximate to the opening 311 so that the second engaging slot 331 of the second positioning rib 33 engages with the retaining fence 14 of the fixing member 10, hence a bottom end of the base 30 is moved inward so that the first resilient lock block 15 of the fixing member 10 is pressed to cause a flexible deformation in the first resilient lock block 15, and then the first resilient lock block 15 moves into the second engaging slot 331 of the second positioning rib 33 to be retained as illustrated in FIG. 7. Besides, a bottom periphery 152 of the first resilient lock block 15 abuts against a bottom face 332 of the second engaging slot 331 as shown in FIG. 8 so that the bottom end of the base 30 is stopped without moving upward.

It is to be noted that the first engaging slot 321 of the first positioning rib 32 is close to the opening 311, accordingly the first positioning rib 32 includes two second resilient lock blocks 322 adjacent to the first engaging slot 321, the retaining fence 14 has a first tilted face 141 formed thereon, and each second resilient block 322 has a second tilted face 323 arranged thereon so as to match with the first tilted face 141 as illustrated in FIG. 6, such that the first engaging slot 321 engages with the retaining fence 14 tightly so that the top end of the base 30 retains with a top end of the fixing member 10 securely without forming a gap or moving easily; wherein the retaining fence 14 includes a beveled guide plane 142 disposed on a top end of the first tilted face 141 so that the second tilted face 323 of the second resilient lock block 322 is guided by the beveled guide plane 142 to move toward the first tilted face 141 smoothly.

The first arcuate projection 151 of the first resilient lock block 15 of the fixing member 10 as illustrated in FIGS. 4 and 7 has a guiding and a retaining functions so that when the first resilient lock block 15 is pressed by the second positioning rib 33, the first arcuate projection 151 slides into the second engaging slot 331 to be retained.

In assembly, the locking device 20 is locked on the outer face 2*a* of the fringe 2 by ways of the bolt elements 21 and the anchors 22 so that related parts between the base 30 and the fixing member 10 are connected together.

Figure 3:
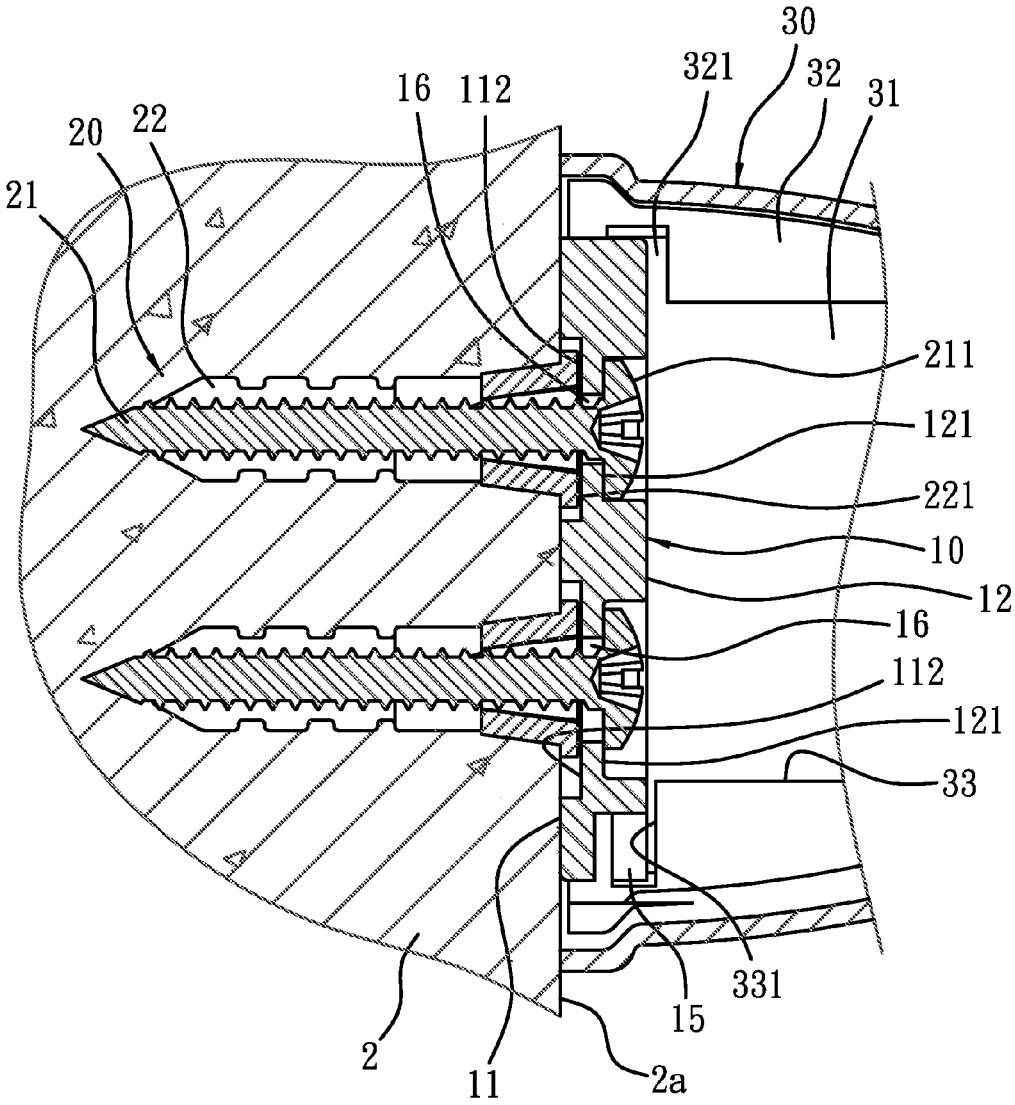
FIG. 3 is a cross sectional view showing the operation of the wall mounting bath accessory assembly according to the first embodiment of the present invention.

In operation, the first engaging slot 321 of the first positioning rib 32 is retained with the retaining fence 14 from the top end of the fixing member 10, and then the bottom end of the base 30 is forced inward so that the second engaging slot 331 of the second positioning rib 33 engages with the first resilient lock block 15 of the fixing member 10, thereby connecting the wall mounting bath accessory assembly 1 easily and quickly as shown in FIG. 3.

In disassembly, the bottom end of the base 30 is forced outward so that the second engaging slot 331 of the second positioning rib 33 disengages from the first resilient lock block 15 of the fixing member 10, and then the base 30 is moved upward until the first engaging slot 321 of the first positioning rib 32 disengages from the retaining fence 14 completely, thus removing the base 30 quickly.

Figure 10:
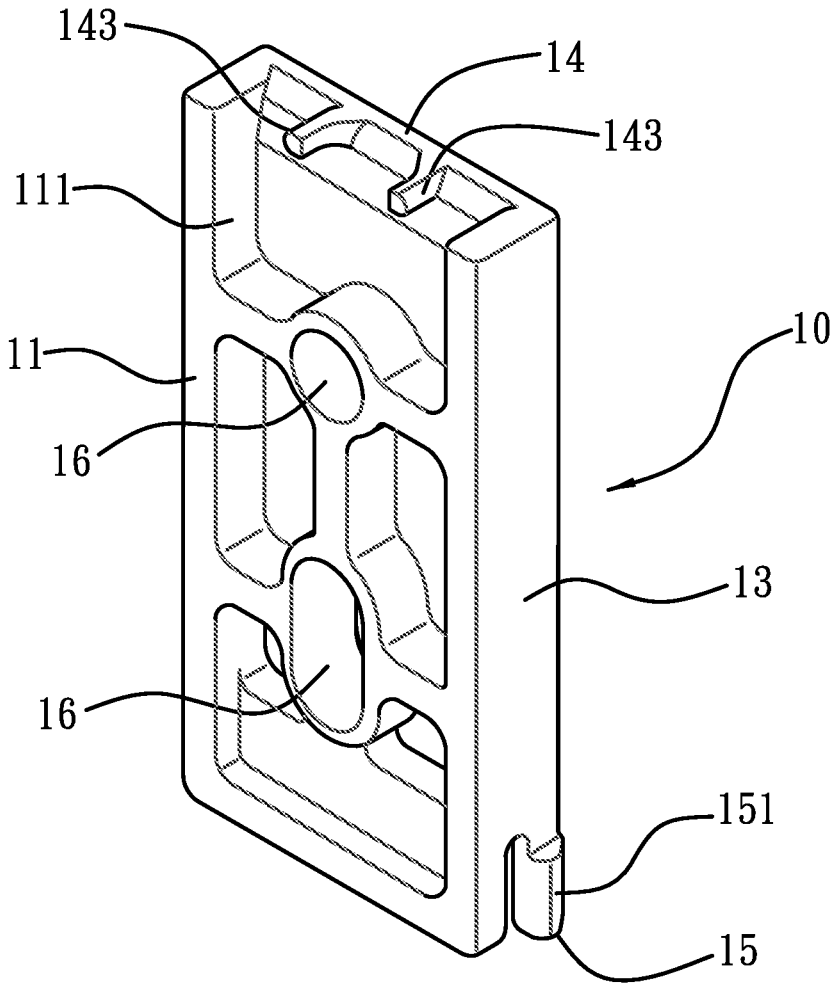
FIG. 10 is a perspective view showing the assembly of the fixing member of the wall mounting bath accessory assembly according to the second embodiment of the present invention.
Figure 11:
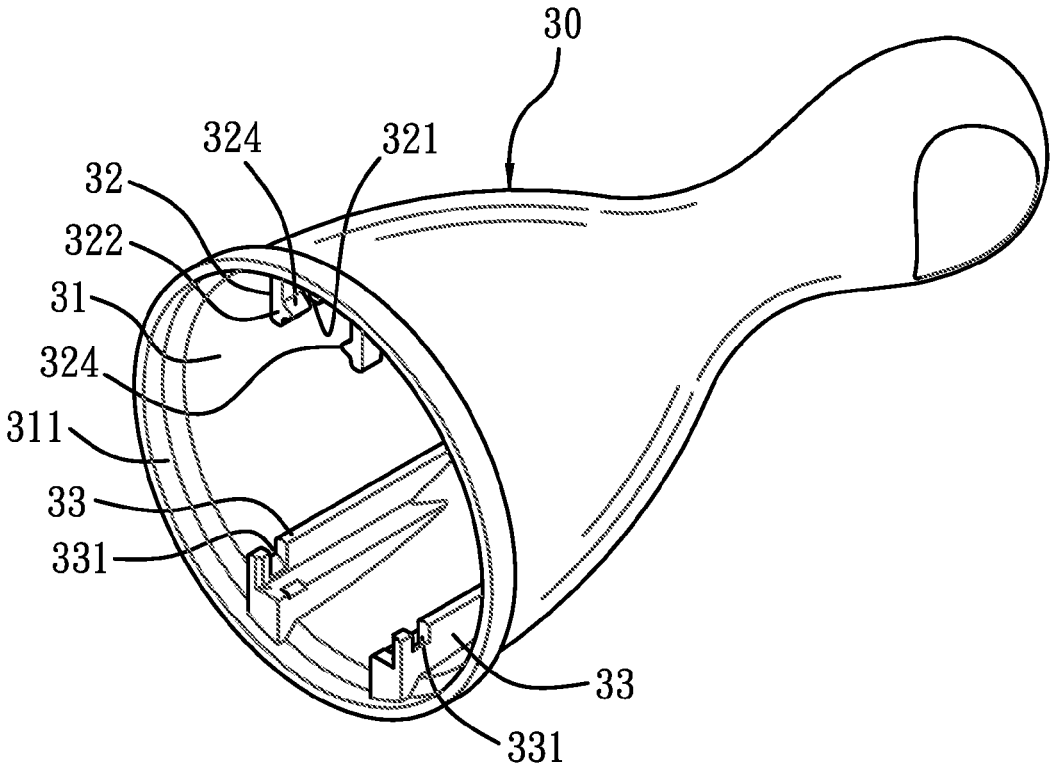
FIG. 11 is a perspective view showing the assembly of the base of the wall mounting bath accessory assembly according to the second embodiment of the present invention.

Referring to FIGS. 9-11, a difference of a wall mounting bath accessory assembly of a second embodiment from that of the first embodiment of the present invention contains:

a fixing member 10 including a recess 111 disposed on an upper side of an inner wall 11 thereof, and a retaining fence 14 including two posts 143 extending therefrom, two first positioning ribs 32 of the base 30 including two second resilient lock blocks 322 adjacent to the first engaging slot 321, and each of the two second resilient lock blocks 322 including a second arcuate projection 324 fixed thereon so that when the first engaging slot 321 engages with the retaining fence 14, two second arcuate projections 324 of the two resilient lock blocks 322 retains with the two posts 143.

The fixing member 10 also includes two holes 16, wherein one of the holes 16 is vertically elongated but not be limited to form in a certain elongation shape. For example, one of the holes 16 is horizontally elongated or vertically elongated, and the other hole 16 is horizontally elongated, or one of the holes 16 is formed in a cross shape so that the fixing member 10 is capable of being moved vertically or horizontally during assembling process to position the fixing member 10 precisely.

Furthermore, the one hole 16 is capable of being formed in a circle shape, and the other hole 16 is vertically elongated, the inner wall 11 and an outer wall 12 of the fixing member 10 includes two recessed rims 112 and two second recessed rims 121 fixed thereon to arrange the two holes 16.

It is to be noted that the locking device 20 is served to connect the fixing member 10 and the base 30 together, but other locking methods are capable of being used to connect the fixing member 10 and the base 30 together. For example, a self-tapping screw is applicable for a specific wall surface.

The base 30 is capable of matching with various hooks to obtain a hanging purpose. Because such a hooking structure is well-known, a further remark is omitted.

When the second resilient lock block 322 of the first positioning rib 32 of the base 30 engages with the post 143 of the fixing member 10, and the second engaging slot 331 of the second positioning rib 33 engages with the first resilient lock block 15 of the fixing member 10, a noise is made to be sure the connecting position is corrected.

While we have shown and described various embodiments in accordance with the present invention, it is clear to those skilled in the art that further embodiments may be made without departing from the scope of the present invention.

What is claimed is:

1. A wall mounting bath accessory assembly comprising a fixing member including an inner wall, an outer wall, and two side walls; the inner wall including at least one recess disposed on an upper side thereof and a retaining fence defined between the recess and the outer wall; on a connecting corner of each side wall and the outer wall being fixed a first resilient lock block, and the first resilient lock block including a first arcuate projection formed thereon;

a base formed in a cover shape and including a groove in which an opening is formed so that the fixing member is received in the groove via the opening, and the groove including two first positioning ribs extending from an inner surface of a top end thereof, and each first positioning rib including a first engaging slot disposed on a bottom end thereof adjacent to the opening so that the first engaging slot engages with the retaining fence, hence a top end of the base prevented from moving outward from the fixing member; the groove including two second positioning ribs extending from an inner surface of a bottom end thereof, and each second positioning rib including a second engaging slot formed on a top end thereof proximate to the opening so that the second engaging slot of the second positioning rib engages with the retaining fence of the fixing member, hence a bottom end of the base is moved inward so that the first resilient lock block of the fixing member is pressed to cause a flexible deformation in the first resilient lock block, and then the first resilient lock block moves into the second engaging slot of the second positioning rib to be retained, a bottom periphery of the first resilient lock block abutting against a bottom face of the second engaging slot so that the bottom end of the base is stopped without moving upward.

2. The wall mounting bath accessory assembly as claimed in claim 1 further comprising a locking device applied to engage the inner wall of the fixing member with an outer face of a fringe tightly.

3. The wall mounting bath accessory assembly as claimed in claim 1, wherein the inner wall of the fixing member includes two recesses disposed on an upper side thereof.

4. The wall mounting bath accessory assembly as claimed in claim 3, wherein the first positioning rib includes two second resilient lock blocks adjacent to the first engaging slot each retaining fence has a first tilted face formed thereon, and each second resilient block has a second tilted face arranged thereon so as to match with the first tilted face, such that the first engaging slot engages with the retaining fence tightly.

5. The wall mounting bath accessory assembly as claimed in claim 4, wherein the retaining fence includes a beveled guide plane disposed on a top end of the first tilted face so that the second resilient lock block is guided by the beveled guide plane to move toward the first tilted face smoothly.

6. The wall mounting bath accessory assembly as claimed in claim 2, wherein the locking device includes two bolt elements and two anchors retained in the outer face, and the fixing member further includes two holes, such that the bolt elements are inserted through the holes to screw with the anchors of the fringe so that the inner wall of the fixing member contacts with the outer face of the fringe.

7. The wall mounting bath accessory assembly as claimed in claim 6, wherein the fixing member includes the two holes vertically arranged thereon, and one of the holes is circular, and the other hole is vertically elongated.

8. The wall mounting bath accessory assembly as claimed in claim 6, wherein the fixing member includes the two holes vertically arranged thereon, and one of the holes is circular, and the other hole is horizontally elongated.

9. The wall mounting bath accessory assembly as claimed in claim 6, wherein the fixing member includes the two holes vertically arranged thereon, and one of the holes is vertically elongated, and the other hole is horizontally elongated.

10. The wall mounting bath accessory assembly as claimed in claim 6, wherein the fixing member includes the two holes vertically arranged thereon, and one of the holes is circular, and the other hole is formed in a cross shape.

11. The wall mounting bath accessory assembly as claimed in claim 6, wherein the inner wall of the fixing member includes two first recessed rims fixed thereon respectively to arrange the two holes, and the inner wall of the fixing member is wide and deep enough to receive a head end of the anchor which exposes outside the outer face of the fringe.

12. The wall mounting bath accessory assembly as claimed in claim 11, wherein the outer wall of the fixing member include two second recessed rims fixed thereon to arranged the two holes and to receive a head end of the other bolt element after the bolt element is inserted through the hole.

13. The wall mounting bath accessory assembly as claimed in claim 1, wherein the fixing member includes the recess disposed on the upper side of the inner wall thereof, and the retaining fence includes two posts extending therefrom; and each of two first positioning ribs of the base includes two second resilient lock blocks adjacent to the first engaging slot, and each of the two second resilient lock blocks includes a second arcuate projection fixed thereon so that when the first engaging slot engages with the retaining fence, two second arcuate projections of the two resilient lock blocks retains with the two posts.

* * * * *